United States Patent [19]

Cochran

[11] 3,934,652

[45] Jan. 27, 1976

[54] APPARATUS AND METHOD FOR CEMENTING WELL LINERS

[75] Inventor: Chudleigh B. Cochran, Houston, Tex.

[73] Assignee: Brown Oil Tools, Inc., Houston, Tex.

[22] Filed: Oct. 15, 1974

[21] Appl. No.: 514,624

[52] U.S. Cl. ..... 166/285; 166/182; 166/208; 166/315

[51] Int. Cl.[2] ..... E21B 33/14; E21B 43/10; E21B 23/00

[58] Field of Search ..... 166/315, 285, 181, 182, 166/208, 123–125

[56] References Cited

UNITED STATES PATENTS

| | | | |
|---|---|---|---|
| 2,894,586 | 7/1959 | Schramm et al. | 166/181 |
| 3,109,490 | 11/1963 | Baker | 166/181 |
| 3,342,268 | 9/1967 | Brown | 166/124 |
| 3,364,996 | 1/1968 | Brown | 166/120 |
| 3,635,288 | 1/1972 | Lebourg | 166/156 |

*Primary Examiner*—Frank L. Abbott
*Assistant Examiner*—George A. Suckfield
*Attorney, Agent, or Firm*—Torres & Berryhill

[57] ABSTRACT

Apparatus and method for cementing a liner in a well bore in which the apparatus may comprise: a setting tool having a tubular mandrel connected in a pipe string for extension through the liner; a liner wiper releasably disposed within the liner near one end of the mandrel; a plug member for effecting a movable seal behind cement as it is pumped through the pipe string into the liner; a seal assembly sealingly engaging the exterior of the mandrel and the interior of the liner above the liner wiper; and a latch assembly releasably connecting the seal assembly to the liner so as to permit limited axial movement of the mandrel without disturbing the axial position of the seal assembly. In the method of cementing a liner using the apparatus, the force due to pressure applied to the seal assembly, during pumping of cement, is transferred to the liner without transfer to the mandrel.

18 Claims, 9 Drawing Figures

APPARATUS AND METHOD FOR CEMENTING WELL LINERS

BACKGROUND OF THE INVENTION

1. Field of the Invention.

The present invention pertains to apparatus and methods for cementing liners in well bores. More specifically, it pertains to apparatus which permits cementing of liners in well bores without some of the attendant pressure problems of the prior art.

2. Brief Description of the Prior Art.

A liner is a section of casing or tubing which is usually suspended in a well casing without normally extending to the surface. Cemented liners are utilized for a number of reasons: providing well control, reducing initial cost of casing, more rapid installation than full casing strings, etc. Liners may be installed entirely within outer casing strings or partially within an open hole.

Conventionally, a liner is set and cemented by first lowering the liner and a setting tool, connected to an operating string, into the well bore. The liner is hung, usually on slips, and the setting tool is released from the liner. Then cement is pumped through the operating string, into the liner, and displaced from the liner, usually through a foot valve, into the annular space between the liner and surrounding casing or well bore.

Usually, at least one wiper plug is introduced into the liner string immediately behind the cement in order to separate the cement from the displacing fluid and to wipe cement from the liner surface as the cement is pushed out of the liner into the surrounding annular space. It is also conventional to utilize at least one additional plug for introduction into the operating string to separate the cement from the displacing fluid and to wipe the cement from the operating string as cement is pumped into the liner. In more recent cementing operations, the plug which is to wipe the operating string is pumped behind the cement until it engages the liner wiper plug and then both plugs are forced downwardly together in the liner string so as to displace cement therefrom and to wipe the liner walls. Such apparatus may be seen in U.S. Pat. No. 3,364,996 - C. C. Brown and U.S. Pat. No. 3,635,288 - Lebourg.

In such cementing operations, it is also necessary to provide some sort of seal in the annular space between the setting tool and the surrounding liner since fluid pressure must be maintained in the operating string during the cementing operation. It has been common to provide this seal by attaching chevron or inverted swab cup type seal assemblies to the setting tool mandrel for sealing engagement with the surrounding liner at some point above the liner wiper plug. However, once the pumpdown plug has engaged the wiper plug and both plugs are forced downwardly through the liner to displace the cement therein, the pressure applied thereto acts against the lower end of the mandrel and the seal assembly applying an upwardly directed force tending to force the operating string out of the well. Therefore, a substantial amount of weight must be maintained on the operating string to prevent this from occurring.

To reduce the forces which tend to force the operating string out of the well, the seal assembly has been directly connected in the liner string. In such cases, the setting tool is provided with a "slick" stinger or mandrel for sealing engagement with an annular seal provided in a central opening of the seal assembly. Thus, the forces acting upwardly on the seal assembly during cementing are transferred to the liner rather than the operating string. However, once cementing has been completed, such a seal assembly must be drilled out. This requires additional time and money and may result in problems.

SUMMARY OF THE INVENTION

The cementing apparatus of the present invention includes a setting tool having a tubular mandrel connected in a pipe string for extension through the liner which is to be set. A wiper seal or plug is releasably disposed within the liner near one end of the mandrel and may have an opening through which cement may be pumped. A pumpdown plug or seal is provided for sliding and sealing engagement with the interior of the pipe string and mandrel, effecting a movable seal behind the cement as it is pumped into the liner. The pumpdown plug is engageable with the wiper plug and movable therewith, upon release of the wiper plug, to effect a movable seal behind the cement as cement is displaced from the liner into the surrounding well bore.

Like in other cementing apparatus, a seal assembly is disposed in the annular space between the mandrel and the liner. However, unlike the prior art, such a seal assembly, which sealingly engages the interior of the liner and the exterior of the mandrel, is releasably connected to the liner by a latch assembly and permits limited axial movement of the mandrel without disturbing the axial position of the seal means.

Since the seal assembly is initially connected to the liner, any pressure acting against the seal, in either direction, is transmitted to the liner and not to the setting tool and operating string as is the case in the prior art. Thus, it is necessary to maintain only enough weight on the operating string to overcome the pressure acting directly on the end of the mandrel. Furthermore, there is no resistance due to hydraulic heads within the space surrounding the operating string when the operating string and setting tool are lifted upwardly relative to the liner.

These are substantial improvements over the prior art. In broad terms, the apparatus of the present invention keeps cement inside and below the setting tool, separates the inside of the liner from the annular area to be cemented and allows axial movement of the setting tool without disengaging the sealing member. All this is made possible by providing a seal which isolates the interior and exterior of the liner during circulating and sealing operations and can be removed without drilling out.

These objects are accomplished by apparatus which is relatively easy to manufacture and operate. Many other objects and advantages of the invention will become apparent from a reading of the description which follows in conjunction with the accompanying drawings.

DESCRIPTION OF A PREFERRED EMBODIMENT

Figure 1:
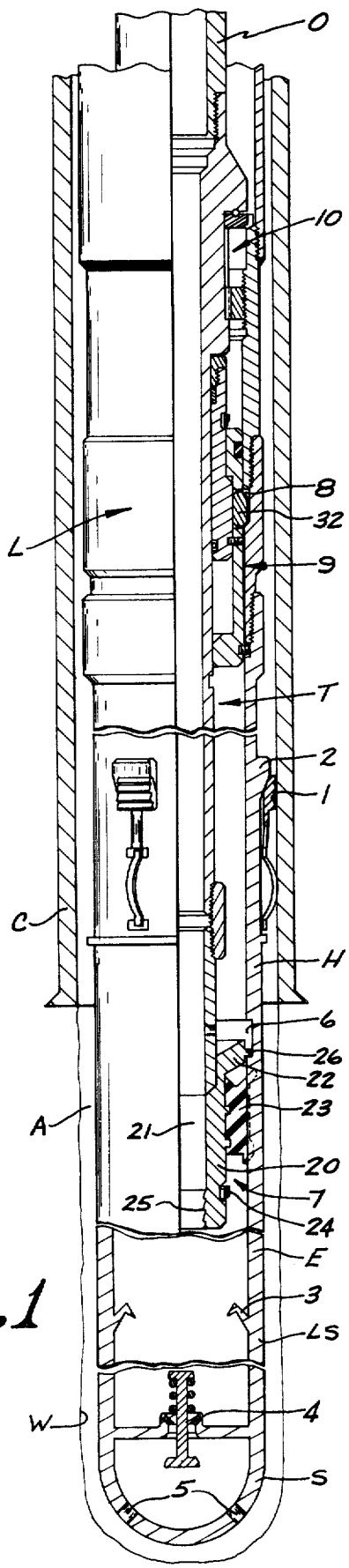
FIG. 1 is an elevation view, partially in section, showing a setting tool, liner string and associated apparatus in a well bore in which the liner string is to be cemented.

Referring first to FIG. 1 of the drawings, there is shown a liner string L disposed near the bottom of a well bore W. The well bore W may or may not be lined by a casing string C which may extend to the surface of the well. In any event, there is an annular space A between the liner string and the surrounding well bore W.

The liner string L may include a liner hanger H, liner extension E, landing section LS and cementing shoe S. In addition, a liner packer (not shown) may be attached to the liner string above the liner hanger H.

Most of the components of the liner string are not materially different from liner components of the prior art. The liner hanger H may be provided with slips 1 and a setting cone 2 by which the liner string is supported in the well bore. Such construction is well known in the industry and will not be described in detail herein. The landing section LS is provided with a seat and latch engaging profile 3 for receiving a liner wiper plug as will be more fully understood hereafter. The cementing shoe S is provided with a back pressure or check valve 4 which permits passage of cement from within the liner into the annular area A via ports 5.

One material difference in the liner string may be the provision of an annular recess 6 by which a liner wiper plug 7 may be initially maintained at a predetermined level within the liner string. In addition, the liner string may be provided with an internal latch profile 8 for engagement by latches of a seal assembly, generally designated by the numeral 9, to be more fully described hereafter.

The liner string L is initially attached by rotatably releasable connector means 10 to a setting tool generally indicated at T. The setting tool T is in turn connected to an operating pipe string O which extends to the surface of a well.

Figure 3:
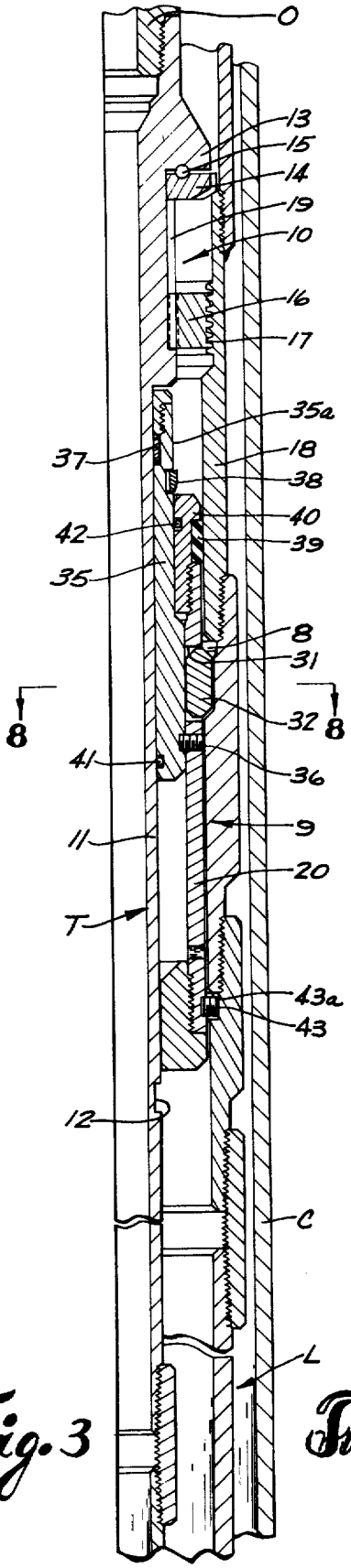
FIG. 3 is a longitudinal sectional view of the invention, showing the setting tool and seal assembly in the initial running in position.

Referring also to FIG. 3, the setting tool T comprises a tubular mandrel 11 provided with an external snap ring groove 12 for cooperation with a seal assembly snap ring, as will be seen hereafter. The upper portion of the setting tool T is provided with an annular shoulder 13 and ring 14 forming races for ball bearings 15. This permits the setting tool and operating string O to be rotated, without axial displacement, relative to the liner string. The bearing ring 14 is adapted to engage a portion of the liner string to remain stationary during such rotation.

The liner string is initially attached to the setting tool T by rotating connector means 10. The rotating connector means 10 may take the form of a lefthand threaded nut 16 which engages coarse lefthand threads 17 on the interior of the hanger setting sleeve 18. The interior of the nut 16 may be provided with longitudinal slots for engagement with corresponding splines 19 on the setting tool T. Thus rotation of the setting tool T in the righthand direction will cause the nut 16 to move upwardly on the splines 19 and to eventually disengage the threads 17 and the setting sleeve 18, effectively releasing the setting tool from the liner string. It should be noted at this point that upon release of the connector means 10, the setting tool T may be raised a limited amount without interrupting the seal between the setting tool mandrel and the seal assembly.

As previously mentioned, a liner wiper plug 7 (see FIG. 1) may be releasably disposed within the liner string near one end of the tool mandrel 11. Such a plug may comprise a tubular body 20 having a central opening 21 therethrough. The body 20 may have an upwardly and outwardly flaring portion 22 creating a guide funnel into the central opening 21. A resilient lip-type seal 23 may be attached to the body for sliding and sealing engagement with the internal walls of the liner string. An external latch, such as a snap ring 24, may be provided around the lower portion of the body 20. The central opening 21 may be provided with a frictionally engageable surface such as downwardly directed teeth 25.

The liner wiper plug 7 may be initially maintained at a predetermined level within the liner string by a frangible projection 26 which engages the annular recess 6 provided in the liner string. In the alternative, the wiper plug 7 may be connected to the setting tool mandrel. It will be noted that the central opening 21 is engaged by the lower end of the mandrel 11 and is in fluid communication with the interior thereof.

Figure 2:
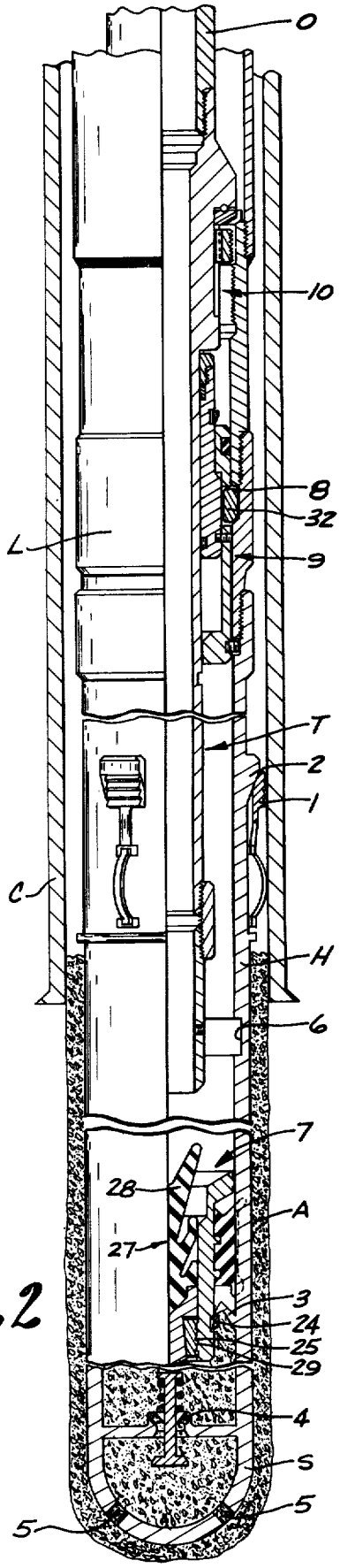
FIG. 2 is an elevation view, partially in section, showing the apparatus of FIG. 1 after cement has been pumped into the annular space between the liner and well bore.

As seen in FIG. 2, a pumpdown plug 27 may also be utilized with the invention. Such a pumpdown plug might be provided with lip-type seals 28 for sliding and sealing engagement with the interior of the operating string O and the setting tool mandrel 11. The pumpdown plug 27 is also sized and adapted to engage the central opening 21 of the liner wiper plug 7. A latching device such as slips 29 may be provided for frictional engagement with the friction surfaces 25 provided in the central opening 21 to latch the pumpdown plug 27 to the liner wiper plug 7.

Figure 8:
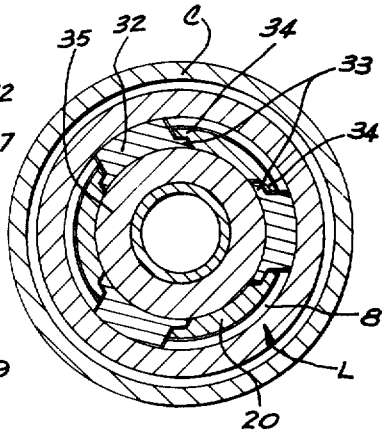
FIG. 8 is a cross-sectional view, taken along line 8—8 of FIG. 3, illustrating the disposition of the latches of the seal assembly in the extended or latched in position.
Figure 9:
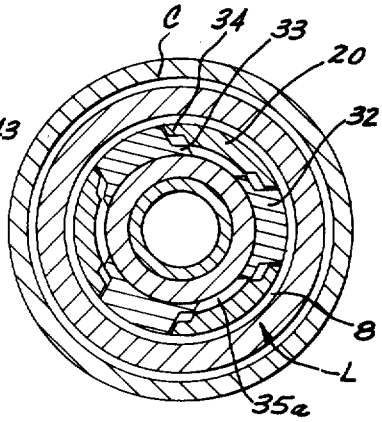
FIG. 9 is a cross-sectional view, taken along line 9—9 of FIG. 6, illustrating the disposition of the latches of the seal assembly in the retracted or released position.

The seal assembly 9 of the preferred embodiment may comprise a body or outer sleeve member 20 having apertures 31 in which are carried latch members 32, which in the extended position of FIG. 3 engage the latch groove 8. Although the latches 32 could be designed in several ways they may be provided, as shown in FIGS. 8 and 9 with longitudinal projections 33 for engagement with corresponding shoulders 34 of the sleeve member 30 to assure that the latches remain in the apertures 31.

Figure 6:
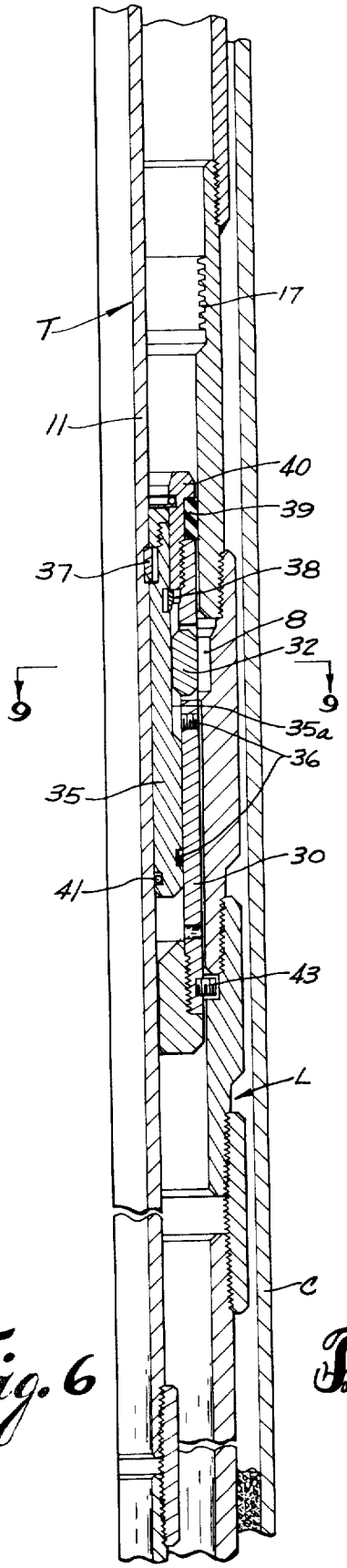
FIG. 6 is a longitudinal sectional view, similar to FIGS. 4 and 5, showing the setting tool set down to release the latches of the seal latch assembly.

The seal assembly also includes an inner sleeve member 35 or cam means which is attached by frangible member 36 to the outer sleeve member 30. In the attached position, as shown in FIG. 3, the inner sleeve prevents retraction of latches 32. However, if the inner sleeve member 35 were removed, the latch members 32 would be retractable within the apertures 31 for disengagement from the latch groove 8. The upper portion of the inner sleeve member 35 has a reduced outside diameter 35a which if in registration with the latch members 32 would also permit their retraction. (See FIG. 6) The inner sleeve member 35 may be provided with inner and outer snap rings 37 and 38, respectively, the function of which will be understood hereafter.

A seal ring 39 attached to the inner sleeve member 30 by seal retainer 40 sealingly engages the interior of the liner string. An annular seal 41 is provided on the inner sleeve member 35 for sliding and sealing engagement with the mandrel 11 of the setting tool T. A seal is also established between the inner and outer sleeve members by annular seal 42. In addition to being held to the liner string by latch members 32, the seal assembly 9 may also be connected by engagement of frangible pin 43 with connection groove 43*a*. It is important to notice that although the seal assembly 9 is attached to the liner string and may not move axially relative thereto, there is nothing in the seal assembly to prevent the setting tool mandrel 11 from moving axially relative to the seal assembly 9.

STATEMENT OF OPERATION OF THE PREFERRED EMBODIMENT

Referring now to FIGS. 1 – 9 of the drawings, operation of the preferred embodiment of the invention would proceed as follows. The liner string L, liner wiper plug 7, seal aysembly 9 and setting tool T would be assembled as is shown in FIGS. 1 and 3 and lowered on operating string O into the well bore W. After reaching the setting depth, the liner hanger would be actuated and hung in a conventional manner. Circulation would be established by pumping circulating fluid down through the operating string O, the setting tool T, the liner string L and through the liner shoe S into the annular space A surrounding the liner string L.

Figure 4:
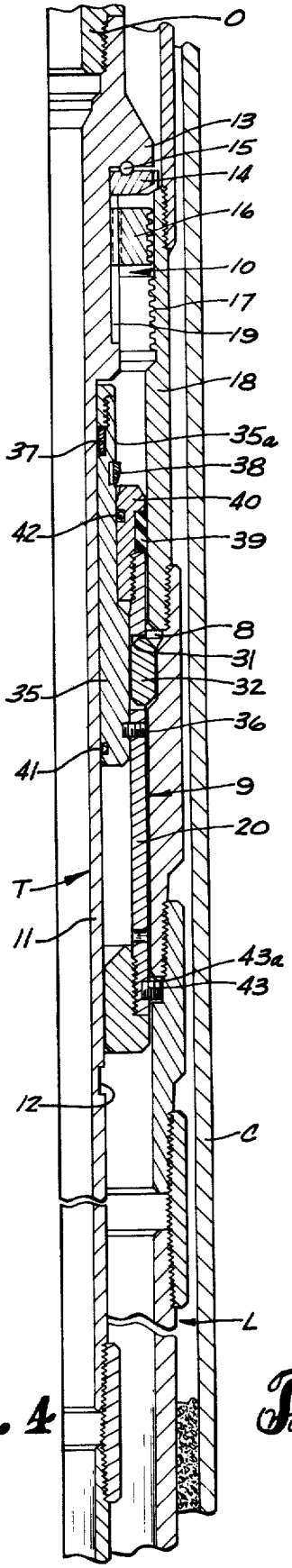
FIG. 4 is a longitudinal sectional view, similar to FIG. 3, showing the setting tool released from the liner.

After circulation is established, the setting tool T is then released from the liner string L by rotating the operating string O in the righthand direction to release the splined nut connector 10 as shown in FIG. 4. The operating string O may be lifted a few inches to be sure that this release has been effected.

A properly measured amount of cement is then pumped into the operating string O. At this point, the pumpdown plug 27 is placed in the operating string O effecting a movable seal behind the cement as it is pumped through the operating string O, setting tool T and the central opening 21 of the liner wiper plug 7 into the liner string. A displacing fluid is pumped behind the pumpdown plug 27 forcing the pumpdown plug 27 into the central opening 21 and into engagement with the liner wiper plug 7.

Further pressure, induced by pumping a displacing fluid behind pumpdown plug 27, will cause the frangible connection 26 between the liner wiper plug 7 and liner string to break releasing both the pumpdown plug 27 and liner wiper plug 7 for further movement down the liner string. The pumpdown plug and liner wiper plug are movable together, upon release of the liner wiper plug, to effect a movable seal behind the cement as the cement is displaced from the liner through the shoe 5 into the annular space A surrounding the liner string L. (See FIGS. 1 and 2). Upon reaching the landing area LS, the liner wiper plug 7 lands and seats in the latch profile 3 and the latching mechanism 24 latches the liner wiper plug 7 and pumpdown plug 27 in the position shown in FIG. 2. At this point, cement should have been pumped upwardly into the annular space A surrounding the liner string to the desired level. The relative position of the setting tool T and seal assembly 9 upon termination of pumping cement is shown in FIG. 4.

It should be noted that during cementing, the force applied to the seal assembly 9 as a result of pressure within the annular space A is transferred to the liner string L and not to the setting tool T or operating string O. Thus, unlike in cementing methods of the prior art, it is not necessary to maintain a great deal of weight on the operating string O to prevent this pressure from forcing the setting tool T and operating string O out of the liner string.

Since the seal assembly 9 is not connected directly to the mandrel 11, the mandrel 11 may be lifted or axially displaced by a limited amount without interrupting the seal between seal member 41 and the exterior of the mandrel 11. See, for example, FIG. 5 in which the setting tool T has been lifted a substantial amount. This may be done to check whether or not the setting tool T has been released from the liner hanger by disengagement of the connector means 10.

Figure 5:
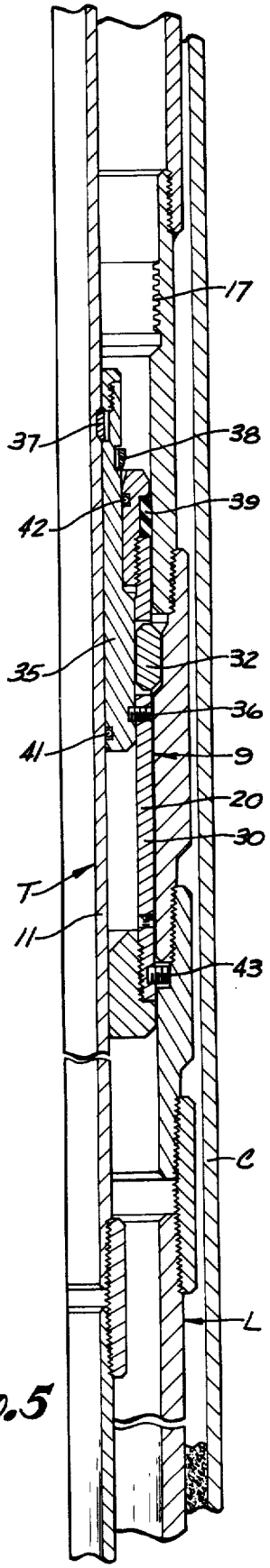
FIG. 5 is a longitudinal sectional view, similar to FIGS. 3 and 4, showing the setting tool picked up to initiate release of the seal latch assembly.

After cementing has taken place and the liner wiper plug and pumpdown plug have been pumped and latched into the landing collar displacing cement into the area surrounding the liner string, the setting tool T may be lifted to the position shown in FIG. 5. At this point, the snap ring 37 carried by the inner sleeve 35 and the seal assembly 9 snaps into engagement with snap ring groove 12 carried on the setting tool mandrel 11. Then, weight may be applied to the setting tool T through the operating string causing the frangible member 36 to shear and allowing the inner sleeve 35 to move downwardly relative to outer sleeve 30 (see FIG. 6). As can be seen, such downward movement places the reduced outside diameter portion 35*a* of the inner sleeve in registration with the latch members 32 permitting their retraction and disengagement from latch groove 8.

Figure 7:
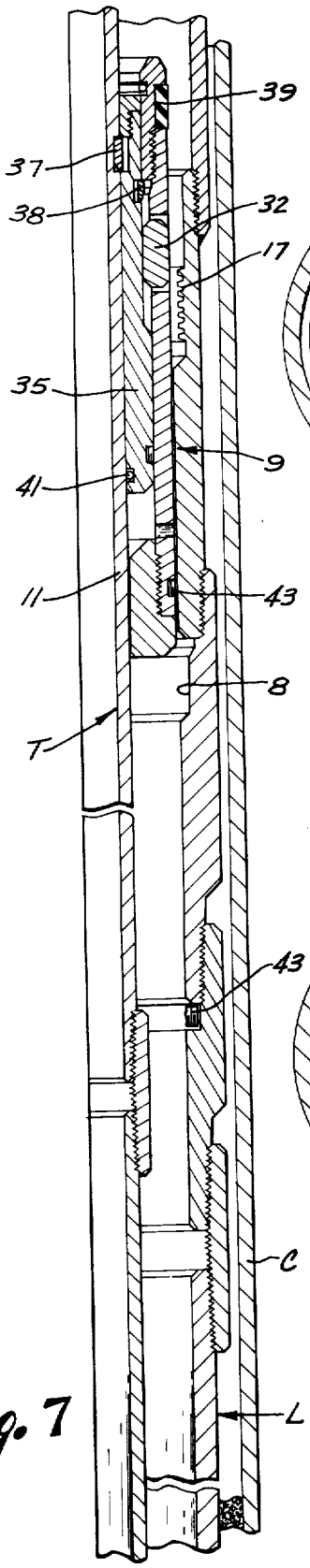
FIG. 7 is a longitudinal sectional view, similar to FIGS. 3–6, showing the setting tool picked up and the seal latch assembly released for removing the setting tool and the seal assembly from the well.

It will also be noted that in its downwardly displaced position, the inner sleeve snap ring 38 is permitted to expand for engagement with the seal retainer 40. This makes it possible now to apply an upwardly directed force to setting tool T, shearing connector 43 and allowing the entire seal assembly 9 to be displaced upwardly with the setting tool T, as shown in FIG. 7. Once the seal is broken between the seal assembly 9 and the surrounding liner string, reverse circulation may take place, if desired, to wash out any excess cement which may remain in the liner string. Then the setting tool T and seal assembly 9 may be withdrawn from the well.

CONCLUSION

As can be seen from the description of the preferred embodiment of the invention the apparatus and method thereof offer improvements and distinct advantages over the prior art. Probably the most apparent advantage is the removal of pressure forces which would normally be transferred from the seal assembly to the operating string. With the unique design of the present invention, these forces are transferred to the liner string and have no effect on the operating string. Thus, maintenance of great weights on the operating string during cementing is eliminated and pressure heads normally encountered in many of the prior art designs when the operating string is lifted are also eliminated.

Although only one embodiment of the invention has been described herein, many variations may be made by those skilled in the art without departing from the spirit of the invention. It is therefore intended that the scope of the invention be limited only by the claims which follow.

I claim:

1. Apparatus for cementing a liner in a well bore comprising:

a. a setting tool having a tubular mandrel connected in a pipe string for extension through said liner;

b. seal means releasably attached to said liner and sealingly engaging the exterior of said mandrel and the interior of said liner permitting at least limited axial movement of said mandrel without movement of said seal means;

c. said seal means comprising latch means engageable with corresponding groove means within said liner to releasably hold said seal means against axial displacement therein, said latch means comprising a plurality of latch members radially movable between extended positions, in which said latch members engage said groove means, and retracted positions, in which said latch members are not in engagement with said groove means;

d. said seal means comprising a sleeve member having a first portion and an axially spaced second portion of less diameter than said first portion, said first portion when in registration with said latch members preventing retraction and disengagement of said latch members from said groove means, said second portion when in registration with said latch members allowing retraction and disengagement of said latch members from said groove means.

2. Apparatus as set forth in claim 1 in which said mandrel and sleeve member are provided with means engageable, upon predetermined axial displacement of said mandrel, to effect said registration of said inner sleeve second portion with said latch members.

3. Apparatus as set forth in claim 1 in which said seal means comprises tubular body means, having apertures in which said latch members are mounted for said radial movement, and cam means movable between a first position engaging and holding said latch members in said extended positions, and a second position permitting said latch members to move to said retracted positions.

4. Apparatus as set forth in claim 3 in which said cam means is initially attached to said body means and held in said first position by means releasable upon application of a predetermined axial force to said mandrel to permit movement to said second position.

5. Apparatus as set forth in claim 4 in which one of said cam means and mandrel is provided with an annular groove engageable with a cooperative latch member carried by the other of said cam means and mandrel upon limited axial movement of said mandrel for applying said predetermined axial force.

6. Apparatus as set forth in claim 4 in which said body means is also attached to said liner by connection means releasable upon application to said mandrel of a force greater than said predetermined force to release said mandrel and seal means for removal from said liner.

7. Apparatus for cementing a liner in a well bore comprising:

a. a setting tool having a tubular mandrel connected in a pipe string for extension through said liner;

b. seal means releasably attached to said liner and sealingly engaging the exterior of said mandrel and the interior of said liner permitting at least limited axial movement of said mandrel without movement of said seal means;

c. said seal means comprising a first sleeve carrying a first annular seal for sealing and sliding engagement with said mandrel and a second sleeve carrying a second annular seal for sealing engagement with said liner;

d. said seal means comprising latch means engageable with corresponding groove means within said liner to releasably hold said seal means against axial displacement therein.

8. Apparatus for cementing a liner in a well bore comprising:

a. a setting tool having a tubular mandrel connected in a pipe string for extension through said liner creating an annular space therebetween;

b. connector means carried by said setting tool for releasably connecting said liner thereto;

c. wiper means releasably disposed within said liner near one end of said mandrel and having a central opening through which cement may be pumped into said liner through said pipe string and mandrel;

d. plug means adapted for sliding and sealing engagement with the interior of said pipe string and mandrel effecting a movable seal behind said cement as it is pumped into said liner, said plug means being engageable with said wiper means and movable therewith, upon release of said wiper means, to effect a movable seal behind said cement as said cement is displaced from said liner into said surrounding well bore;

e. seal means disposed in said annular space and comprising a first sleeve carrying a first annular seal for sealingly engaging the interior of said liner and a second sleeve carrying a second annular seal for sealingly engaging the exterior of said mandrel; and f. latch means releasably connecting said seal means to said liner permitting limited axial movement of said mandrel without disturbing the axial position of said seal means.

9. Apparatus for cementing a liner in a well bore as set forth in claim 8 in which said connector means is operable by rotation of said mandrel to release said mandrel for said limited axial movement relative to said liner.

10. Apparatus as set forth in claim 8 in which said latch means comprises a plurality of latches carried by said first sleeve for movement from extended positions, engaging corresponding surfaces carried by said liner, to retracted positions not engaging said corresponding liner surfaces, said latches being held in said extended positions by the exterior of said second sleeve preventing axial movement of said seal means relative to said liner.

11. Apparatus as set forth in claim 10 in which said second sleeve is provided with a reduced diameter portion which upon registration with said latch means by predetermined axial movement of said mandrel permits movement of said latches to said retracted positions to permit removal of said seal means from said liner.

12. Apparatus for cementing a liner in a well bore comprising:

a. a setting tool having a tubular mandrel connected in a pipe string for extension through said liner creating an annular space therebetween;

b. connector means carried by said setting tool for releasably connecting said liner thereto;

c. wiper means releasably disposed within said liner near one end of said mandrel and having a central opening through which cement may be pumped into said liner through said pipe string and mandrel;

d. plug means adapted for sliding and sealing engagement with the interior of said pipe string and mandrel effecting a movable seal behind said cement as it is pumped into said liner, said plug means being engageable with said wiper means and movable therewith, upon release of said wiper means, to effect a movable seal behind said cement as said cement is displaced from said liner into said surrounding well bore;

e. seal means disposed in said annular space sealingly engaging the interior of said liner and the exterior of sand mandrel; and f. latch means releasably connecting said seal means to said liner permitting limited axial movement of said mandrel without disturbing the axial position of said seal means, said latch means comprising an outer sleeve member carried by said seal means, having apertures in which are carried latch members movable from an extended position engaging corresponding surfaces in said liner to retracted positions free of said corresponding surfaces; and an inner sleeve member axially movable from a first position, engaging said latch members and holding them in said engagement with said liner surfaces, to a second position permitting movement of said latch members to their retracted positions and permitting removal of said seal means from said liner.

13. Apparatus as set forth in claim 12 in which said inner sleeve member is initially connected to said outer sleeve member in said first position by releasable connection means.

14. Apparatus as set forth in claim 13 in which said inner sleeve member and mandrel are provided with cooperable attachment means engageable upon predetermined axial movement of said mandrel to attach said inner sleeve member to said mandrel for release of said connection means and movement of said inner sleeve member to said second position on further axial movement of said mandrel.

15. Apparatus as set forth in claim 14 in which said outer sleeve member is connected to said liner by means frangible upon application of an axial force to said seal means, when said inner sleeve member is in said second position, to permit removal of said mandrel and seal means from said liner.

16. A method of cementing a liner in a well bore with a setting tool, having a tubular mandrel, connected to an operating string, comprising the steps of:

a. lowering said setting tool with said liner attached therearound into said well bore, wiper means sealingly engaging the interior of said liner and seal means sealingly engaging the interior of said liner and the exterior of said mandrel;

b. anchoring said liner in said well bore;

c. releasing said setting tool from said liner;

d. pumping cement into said liner through said operating string and tool mandrel;

e. pumping plug means, sealingly engaging said operating string and mandrel, behind said cement into engagement with said wiper means;

f. pumping said cement out of said liner into said surrounding well bore by forcing said plug means and wiper means through said liner;

g. releasing said seal means by predetermined nonrotating axial movement of said mandrel; and h. removing said setting tool and seal means from said well bore.

17. A method of cementing a liner in a well bore as set forth in claim 16 in which the force due to pressure applied to said seal means during said pumping of said cement is transmitted to said liner without transmission to said mandrel.

18. A method of cementing a liner in a well bore as set forth in claim 16 in which the force applied to said seal means due to any fluid head within said well bore above said seal means is transmitted to said liner without transmission to said mandrel.

* * * * *

Notice of Adverse Decision in Interference

In Interference No. 99,680, involving Patent No. 3,934,652, C. B. Cochran, APPARATUS AND METHOD FOR CEMENTING WELL LINERS, final judgment adverse to the patentee was rendered Apr. 9, 1980, as to claim 7.

[*Official Gazette July 22, 1980.*]

REEXAMINATION CERTIFICATE (497th)

United States Patent [19]

Cochran

[11] B1 3,934,652

[45] Certificate Issued May 6, 1986

[54] APPARATUS AND METHOD FOR CEMENTING WELL LINERS

[75] Inventor: Chudleigh B. Cochran, Houston, Tex.

[73] Assignee: Hughes Tool Co.

Reexamination Requests:
No. 90/000,498, Feb. 6, 1984
No. 90/000,657, Oct. 29, 1984

Reexamination Certificate for:

| | |
|---|---|
| Patent No.: | **3,934,652** |
| Issued: | **Jan. 27, 1976** |
| Appl. No.: | **514,624** |
| Filed: | **Oct. 15, 1974** |

[51] Int. Cl.[4] ..... E21B 33/14; E21B 43/10; E21B 23/00

[52] U.S. Cl. ..... 166/285; 166/182; 166/208; 166/382

[56] References Cited

U.S. PATENT DOCUMENTS

| | | | |
|---|---|---|---|
| 2,980,185 | 4/1961 | Daffin | 166/211 |
| 3,109,490 | 11/1963 | Baker | 166/114 |
| 3,171,490 | 3/1965 | States | 166/124 |
| 3,291,220 | 12/1966 | Mott | 166/208 |
| 3,364,996 | 1/1968 | Brown | 166/120 |
| 3,450,204 | 6/1969 | Brown et al. | 166/124 |
| 3,608,634 | 9/1971 | Cochran | 166/208 |
| 3,910,349 | 10/1975 | Brown et al. | 166/153 |
| 3,920,075 | 11/1975 | Braddick et al. | 166/290 |
| 4,281,711 | 8/1981 | Braddick et al. | 166/118 |

*Primary Examiner*—James A. Leppink
*Assistant Examiner*—William P. Neuder

[57] ABSTRACT

Apparatus and method for cementing a liner in a well bore in which the apparatus may comprise: a setting tool having a tubular mandrel connected in a pipe string for extension through the liner; a liner wiper releasably disposed within the liner near one end of the mandrel; a plug member for effecting a movable seal behind cement as it is pumped through the pipe string into the liner; a seal assembly sealingly engaging the exterior of the mandrel and the interior of the liner above the liner wiper; and a latch assembly releasably connecting the seal assembly to the liner so as to permit limited axial movement of the mandrel without disturbing the axial position of the seal assembly. In the method of cementing a liner using the apparatus, the force due to pressure applied to the seal assembly, during pumping of cement, is transferred to the liner without transfer to the mandrel.

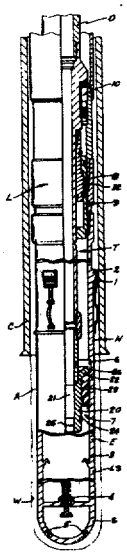

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 7 was previously cancelled.

Claims 1–6, 8, 9, and 12–18 are cancelled.

Claim 10 is determined to be patentable as amended.

Claim 11, dependent on an amended claim, is determined to be patentable.

10. [Apparatus as set forth in claim 8 in which said latch means comprises:] *Apparatus for cementing a liner in a well bore comprising:*

*a. a setting tool having a tubular mandrel connected in a pipe string for extension through said liner creating an annular space therebetween;*

*b. connector means carried by said setting tool for releasably connecting said liner thereto;*

*c. wiper means releasably disposed within said liner near one end of said mandrel and having a central opening through which cement may be pumped into said liner through said pipe string and mandrel;*

*d. plug means adapted for sliding and sealing engagement with the interior of said pipestring and mandrel affecting a movable seal behind said cement as it is pumped into said liner, said plug means being engageable with said wiper means and movable therewith, upon release of said wiper means, to effect a movable seal behind said cement as said cement is displaced from said liner into said surrounding well bore;*

*e. seal means disposed in said annular space and comprising a first sleeve carrying a first annular seal for sealingly engaging the interior of said liner and a second sleeve carrying a second annular seal for sealingly engaging the exterior of said mandrel;*

*f. latch means releasably connecting said seal means to said liner permitting limited axial movement of said mandrel without disturbing the axial position of said seal means, said latch means comprising* a plurality of latches carried by said first sleeve for movement from extended positions, engaging corresponding surfaces carried by said liner, to retracted positions not engaging said corresponding liner surfaces, said latches being held in said extended positions by the exterior of said second sleeve preventing axial movement of said seal means relative to said liner.

* * * * *